US010887682B1

(12) United States Patent
Pantea et al.

(10) Patent No.: US 10,887,682 B1
(45) Date of Patent: Jan. 5, 2021

(54) RESONANCE-ENHANCED COMPACT NONLINEAR ACOUSTIC SOURCE OF LOW FREQUENCY COLLIMATED BEAM FOR IMAGING APPLICATIONS IN HIGHLY ATTENUATING MEDIA

(71) Applicant: Los Alamos National Security, LLC, Los Alamos, NM (US)

(72) Inventors: Cristian Pantea, Los Alamos, NM (US); Dipen N. Sinha, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 313 days.

(21) Appl. No.: 15/902,939

(22) Filed: Feb. 22, 2018

Related U.S. Application Data

(60) Provisional application No. 62/462,276, filed on Feb. 22, 2017.

(51) Int. Cl.
*H04R 1/28* (2006.01)
*H04R 3/04* (2006.01)

(52) U.S. Cl.
CPC ..... *H04R 1/2811* (2013.01); *H04R 3/04* (2013.01)

(58) Field of Classification Search
CPC ..... H04R 1/2811; H04R 3/04; G01S 7/52038
See application file for complete search history.

(56) References Cited

U.S. PATENT DOCUMENTS

| | | | | |
|---|---|---|---|---|
| 3,872,421 | A * | 3/1975 | Rogers | G10K 11/22 367/162 |
| 9,843,400 | B2 * | 12/2017 | Sinha | G10K 11/04 |
| 2011/0080804 | A1 * | 4/2011 | Vu | G01V 1/00 367/32 |
| 2012/0186904 | A1 * | 7/2012 | Cheng | G10K 11/04 181/175 |
| 2016/0013871 | A1 | 1/2016 | Sinha et al. | |

OTHER PUBLICATIONS

Pantea et al., "Resonance-Enhanced Compact Nonlinear Acoustic Source of Low Frequency Collimated Beam for Imaging Applications in Highly Attenuating Media," *5Joint Meeting of the Acoustical of America and the Acoustical Society of Japan*, 17 pages (Nov. 30, 2016).

Saito, "Nonlinearity Parameter Measurement for Polymer Plates Using Focused Ultrasound," *AIP Conference Proceedings*, 1022:561-564 (Jun. 2008).

Pantea et al., "Acoustical Filters and Nonlinear Acoustic Waves in Liquids," ASA Meeting Seattle, 16 pages (May 2011).

(Continued)

*Primary Examiner* — Daniel Pihulic

(74) *Attorney, Agent, or Firm* — Klarquist Sparkman, LLP

(57) ABSTRACT

Acoustic signal sources include acoustic resonators that include acoustic nonlinear materials. Acoustic signals at higher frequencies are mixed in the nonlinear materials to produce a lower frequency acoustic signal. Resonance provides increased efficiency in producing acoustic signals at difference frequencies corresponding to resonance frequencies. Higher frequency acoustic signals used in nonlinear mixing are preferably at frequencies corresponding to resonance frequencies as well.

25 Claims, 8 Drawing Sheets

(56) References Cited

OTHER PUBLICATIONS

Pantea et al., "Resonance-Enhanced Compact Nonlinear Acoustic Source of Low Frequency Collimated Beam for Imaging Applications in Highly Attenuating Media," Abstract only—*The Journal of the Acoustical Society of America*, 140, 1 page (Nov. 2016).
Saito, "Nonlinearity Parameter Measurement for Polymer Plates Using Focused Ultrasound," Abstract only—*AIP Conference Proceedings*, 1022, 3 pages (Jun. 2008).
Saito et al., "Nonlinearity Parameter Measurement for Polymer Plates Using Focused Ultrasound," *Jpn. J. Appl. Phys.*, 47:7380-7385 (2008).
Sinha et al., "Broadband unidirectional ultrasound propagation using sonic crystal and nonlinear medium," *Emerging Materials Research*, 2:117-126 (Jun. 4, 2013).
Sturtevant et al., "The acoustic nonlinearity parameter in Fluorinert up to 381 K and 13.8 MPa," *J. Acoust. Soc. Am.*, 138:EL31-EL35 (Jul. 2015).

* cited by examiner

Δf = 99 kHz

Amplitude (V)
0.45
0.40
0.35
0.30
0.25
0.20
0.15
0.10
0.05
0.00
0.5
0.6
0.7
0.8
0.9
1.0
1.1
1.2
1.3
1.4
1.5
f1 (MHz)

Δf = 83 kHz

Amplitude (V)
0.45
0.40
0.35
0.30
0.25
0.20
0.15
0.10
0.05
0.00
0.5
0.6
0.7
0.8
0.9
1.0
1.1
1.2
1.3
1.4
1.5
f1 (MHz)

RESONANCE-ENHANCED COMPACT NONLINEAR ACOUSTIC SOURCE OF LOW FREQUENCY COLLIMATED BEAM FOR IMAGING APPLICATIONS IN HIGHLY ATTENUATING MEDIA

CROSS REFERENCE TO RELATED APPLICATION

This application claims the benefit of U.S. Provisional Application No. 62/462,276, filed Feb. 22, 2017, which is hereby incorporated by reference in its entirety.

ACKNOWLEDGMENT OF GOVERNMENT SUPPORT

This invention was made with government support under Contract No. DE-AC52-06NA25396 awarded by the U.S. Department of Energy. The government has certain rights in the invention.

FIELD

The disclosure pertains to acoustic wave generation.

BACKGROUND

Acoustic interrogation of features (e.g., defects, embedded objects etc.) in different media in fields such as non-destructive evaluation or imaging often requires a collimated beam of low frequency. This is because high acoustic attenuation in many media limits the depth of penetration of typically used high-frequency commercially available ultrasonic imaging probes and so only a small region can be explored or imaged. For example, at frequencies greater than 1 MHz, sound does not penetrate the human skull. Similarly, in drilling mud, sound penetration depth is only a few mm at MHz frequencies. The same is true for concrete, rocks, and many other materials of interest. In addition, tight beam collimation is needed in order to provide suitable lateral resolution for imaging, or to assure that the acoustic beam is not affected by the interaction of the beam with sides of the material under study. Low frequency sound is needed for penetration of the acoustic beam into the material of interest because acoustic attenuation is directly proportional to acoustic frequency as $\sim f^n$, where f is the acoustic frequency and n is a factor between one and two that depends on the specific medium (e.g., n=1 for solids and ~2 for liquids). Conventional low-frequency acoustic transducers have spherical beam spreads, limiting lateral resolution.

Acoustic imaging in highly attenuating media (e.g., human body, concrete, rocks, mud, etc.) thus requires special acoustic sources that can generate a collimated beam of low frequency (typically <1 MHz). As noted above, this is because acoustic absorption increases with frequency and this limits the use of high frequencies based on penetration depth into the medium. Lower frequencies, in the range of 10-120 kHz, have the advantage of deeper penetration due to lower acoustic attenuation. However, conventional acoustic sources at these low frequencies suffer from large size and large beam spread, which adversely affect lateral spatial resolution. One special type of source, called a parametric array can provide a low frequency, collimated acoustic beam but typically requires a long frequency mixing length in an acoustic nonlinear medium. Such sources are not widely available and are typically used for underwater sonar type of imaging at frequencies <10 kHz. In conventional acoustic transducers where size is not an issue, to obtain high collimation, acoustic frequency needs to be high or the diameter of the acoustic source needs to be very large. These conditions are associated with significant limitations on the use of such sources for many practical applications where space is limited (e.g., endoscopic imaging or imaging downhole through oil wells etc.).

SUMMARY

Disclosed herein are compact sources that rely on parametric frequency mixing but use a resonance approach where acoustic cavity resonance is used to enhance efficiency, in some cases by an order of magnitude or more. The disclosed approaches enable very compact sources to be designed. In one example, a source is configured with approximate dimensions of a cylinder with a diameter of 25-50 millimeters and a height of about 10 mm. Such compact, low frequency acoustic sources can provide collimated and steerable acoustic beams. Typically, the disclosed approaches take advantage of (1) frequency mixing in an acoustical nonlinear fluid (or other nonlinear material) in a cavity to generate a difference frequency between two high frequencies, such as around 1 MHz, and (2) resonance enhancement of the difference frequency in the cavity. In one example, an order of magnitude enhancement in acoustic amplitude was observed between on-resonance and off-resonance conditions, with a beam collimation of approximately 6 degrees. While examples are described with reference to particular frequencies and device geometries, these are for purposes of illustration, and similar methods and devices can be provided that operate at different (higher or lower) frequencies, and devices can be larger or smaller.

According to one example, acoustic sources comprise an acoustic resonator defining a resonator volume and an acoustic nonlinear material situated in the resonator volume. An acoustic transducer is situated to direct an acoustic signal into the resonator volume, and an electrical signal source is coupled to the acoustic transducer so as to apply an electrical signal at a carrier frequency to the acoustic transducer to produce an acoustic signal at the carrier frequency. An acoustic signal at a difference frequency is produced based on a nonlinear coefficient of the acoustic nonlinear material. In some examples, the electrical signal at the at least one carrier frequency is an amplitude modulated electrical signal at a selected carrier frequency and the difference frequency is a frequency of the amplitude modulation. In other examples, the electrical signal at the at least one carrier frequency includes electrical signals at a first frequency and a second frequency, and the difference frequency corresponds to a difference between first frequency and the second frequency, wherein the difference frequency is a resonance frequency of the acoustic resonator. In some examples, the acoustic resonator is a linear resonator or a ring resonator. In other embodiments, the electrical signal at the at least one carrier frequency is tunable so as to correspond to resonance frequency of the acoustic resonator. According to some examples, the acoustic resonator comprises a first acoustic resonator section having a first length and a second acoustic resonator section having a second length, wherein the first acoustic resonator section and the second acoustic resonator section are operable to adjust a total resonator length. In further examples, a bellows couples the first acoustic resonator section and the second acoustic resonator section so that the first acoustic resonator section and the second acoustic resonator section are movable to adjust a total resonator length. In still other examples, an O-ring seal is situated between the first acoustic resonator section and the second acoustic resonator section so that the first acoustic resonator section and the second acoustic resonator section are slidable with respect to each other so as to adjust a total resonator length. In some examples, the acoustic nonlinear material is a FLUORINERT electronics cooling liquid. FLUORINERT electronics cooling liquids are electrically insulating, stable fluorocarbon-based fluids, used in various cooling applications, and available from 3M. Such liquids are mainly used for cooling electronics but some such liquids have excellent acoustic nonlinear properties with a very low sound speed (~640 m/s at 27° C.). The low sound speed, because of the associated lower wavelength at any given frequency compared high sound speed liquids (e.g., 1480 m/s for water), allows for a very compact acoustic source. The acoustic nonlinear properties of FLUORINERT FC-43 electronics cooling liquid are described in detail in Sturtevant et al., J. Acoustic. Soc. Am. Express Letters 138(1) (July 2015), which is incorporated herein by reference.

Systems for generating an acoustic signal comprise an acoustic resonator defining a resonator volume and an acoustic nonlinear material situated so as to at least partially fill the resonator volume. A tunable electrical signal source produces an electrical signal at a least one tunable frequency that is coupled to an acoustic transducer that directs an acoustic signal in response to the electrical signal into the acoustic resonator at an acoustic resonator resonance frequency so as to produce and output an acoustic signal at a difference frequency. In some examples, an acoustic resonator tuner that includes piezoelectric device, a screw, or a mechanical stage is coupled to adjust resonance frequencies of the acoustic resonator by adjusting acoustic path length. In some examples, the acoustic resonator includes a first section and a second section that are movable with respect to each other so as to adjust resonance frequencies of the acoustic resonator.

Methods comprise applying a first electrical signal to at least one acoustic transducer to produce a first acoustic signal and directing the first acoustic signal into an acoustic resonator. The electrical signal is tuned so that the first acoustic signal is at a frequency corresponding to a resonance frequency of an acoustic resonator that contains an acoustic nonlinear material. A second electrical signal is applied to the at least one acoustic transducer to produce a second acoustic signal and the second acoustic signal is directed into the acoustic resonator. The second electrical signal is tuned so that the second acoustic signal is at a frequency corresponding to a resonance frequency of the acoustic resonator so that the first and second acoustic signals produce an output acoustic signal at a difference frequency based on interaction in the acoustic nonlinear material.

These and other features of the disclosed technology are set forth below with reference to the accompanying drawings.

BRIEF DESCRIPTION OF THE DRAWINGS

FIG. 1A illustrates difference frequency generation using a single acoustic transducer. FIG. 1B illustrates demodulation of an amplitude modulated carrier to produce an acoustic signal at a modulation frequency. FIG. 1C illustrates difference frequency generation using separate acoustic transducers for each input frequency.

DETAILED DESCRIPTION

Figure 1A:
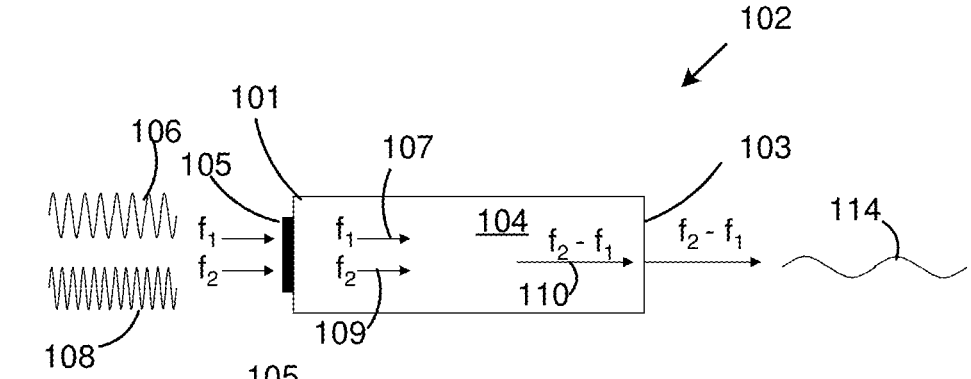
FIGS. 1A-1C illustrate acoustic difference frequency generation with an acoustic resonator that contains a nonlinear acoustic material.

As used in this application and in the claims, the singular forms "a," "an," and "the" include the plural forms unless the context clearly dictates otherwise. Additionally, the term "includes" means "comprises." Further, the term "coupled" does not exclude the presence of intermediate elements between the coupled items.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved. Any theories of operation are to facilitate explanation, but the disclosed systems, methods, and apparatus are not limited to such theories of operation.

In some examples, values, procedures, or apparatus' are referred to as "lowest", "best", "minimum," or the like. It will be appreciated that such descriptions are intended to indicate that a selection among many used functional alternatives can be made, and such selections need not be better, smaller, or otherwise preferable to other selections.

Terms such as "acoustic signal" and "acoustic wave" are used herein to refer to mechanical waves such as sound, ultrasound, or other mechanical vibrations. In typical examples, longitudinal acoustic waves are produced, but transverse (shear) waves, surface waves, plate waves, or others can be produced as well. In typical examples, acoustic signals are generated by applying a suitable electrical signal to an acoustic transducer such as a piezoelectric transducer. As used herein, "electrical signal" refers to a time varying electrical current or voltage (or combination thereof). In some examples, an electrical signal that is time varying at a single frequency can be amplitude or frequency modulated to produce additional frequencies. An electrical signal at a single frequency is referred to herein as a carrier signal. Acoustic resonators include acoustic reflectors that are spaced apart along an acoustic signal path. A volume between acoustic reflectors and containing the acoustic signal path is referred to as a cavity or resonator cavity, although such volume is typically partially or completely filled. An acoustic length of the acoustic signal path depends on acoustic signal propagation speed and path length in any acoustic materials situated along the acoustic signal path so that resonance frequencies are integer multiples of $$2\Big/\left(\frac{L_1}{v_1}+\frac{L_2}{v_2}+\ldots+\frac{L_n}{v_n}\right),$$

wherein $L_i$ refers to a length along an $i^{th}$ portion of an acoustic signal path and vi is an acoustic speed along the $i^{th}$ portion of the acoustic signal path. As shown below, the acoustic signal path can be a straight, folded, or ring-shaped.

Some acoustic materials, devices, reflectors and filters that can be used with the disclosed methods and apparatus are described in U.S. Patent Application Publication 2016/0013871, which is incorporated herein by reference.

For convenience, certain aspects of mathematics that can be used to describe acoustic nonlinear mixing are provided below. The equation of motion for plane elastic waves propagating through a nonlinear medium, in the absence of body forces can be written as:

$$\rho\frac{\partial^2 u_i}{\partial t^2}=\frac{\partial \sigma_{ij}}{\partial x_j}$$

wherein t is time, ρ is mass density, $u_i$ is a component of a displacement vector, $x_j$ is a material coordinate, and $\sigma_{ij}$ is an element of a stress tensor. An acoustical nonlinear parameter of an isotropic medium $$\beta=-\frac{3C_{11}+C_{111}}{2C_{11}},$$

wherein $c_{11}$ and $c_{111}$ are the second-order and third-order elastic constants of the material. For water, β=5 and FLUORINERT FC-43 has β=7.6. The efficiency of mixing in FLUORINERT FC-43 is about 20 dB larger than in water. Typically, β values greater than 5, 7, 10, 15, or 20 are preferred for efficiency.

An excitation u° that consists of two high frequency components (angular frequencies $\omega_1$, $\omega_2$ corresponding to frequencies $f_1$, $f_2$ and associated with propagation constants $k_1$, $k_2$) can be written as:

$$u^0=A\cos(k_1x-\omega_1t)+B\cos(k_2x-\omega_2t)$$

Using perturbation theory, the solution can be written as:

$$u(x,t)=A\cos(k_1x-\omega_1t)+B\cos(k_2x-\omega_2t)-\frac{\beta k_1^2A^2}{4}x\cos(2k_1x-2\omega_1t)-\frac{\beta k_2^2B^2}{4}x\cos(2k_2x-2\omega_2t)+\frac{\beta k_1k_2AB}{2}x\cos[(k_1-k_2)x-(\omega_1-\omega_2)t]-\frac{\beta k_1k_2AB}{2}x\cos[(k_1+k_2)x-(\omega_1+\omega_2)t]$$

In the examples described in detail herein, the difference frequency term (ω1−ω2) is generally of more interest than other terms.

Figure 1B:
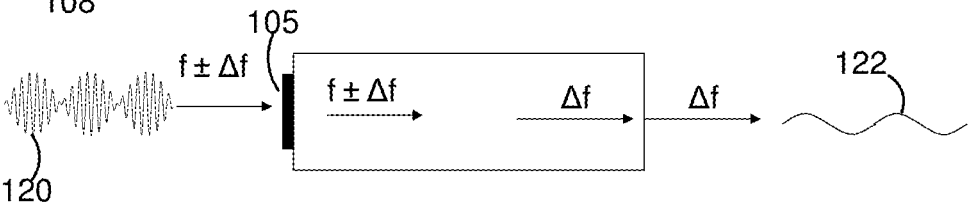
Figure 1C:
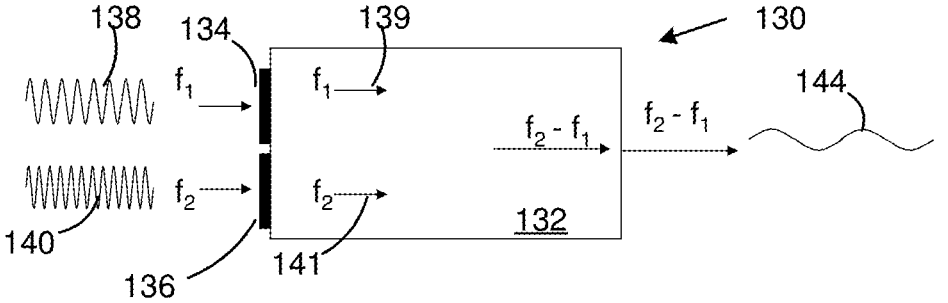

FIGS. 1A-1C illustrate representative nonlinear acoustic mixing apparatus. Referring to FIG. 1A, an acoustic resonator 102 comprises a nonlinear medium 104 situated between a first end 101 and a second end 103. An acoustic transducer 105 is situated to produce acoustic signals and direct the acoustic signals into the nonlinear medium 104. As shown in FIG. 1A, a first electrical signal 106 and a second electrical signal 108 at respective frequencies $f_1$, $f_2$ are coupled to the acoustic transducer 105 so as to produce corresponding acoustic signals 107, 109. Interaction of the acoustic signals at frequencies $f_1$, $f_2$ in the nonlinear medium 104 produces acoustic signals at sum and difference frequencies. As shown in FIG. 1A, an acoustic signal 110 at the difference frequency $f_2-f_1$ is coupled out of the acoustic resonator at the second end 103 to produce an output acoustic signal 114 at the difference frequency. A sum frequency acoustic signal is also produced, but is not shown and is generally highly attenuated in the nonlinear medium 104.

The acoustic resonator of FIG. 1A is a linear resonator defined by the first end 101 and the second end 103. To increase acoustic signal intensities in the nonlinear medium 104 at the frequencies $f_1$, $f_2$, acoustic signals at these frequencies are preferably highly reflected so as to be retained in the nonlinear medium 104. By contrast, the acoustic signal 110 at the difference frequency is preferably highly transmitted. In some examples, a low pass filter is provided at the second end 103 (and/or the first end 101) that preferably reflects acoustic signals at $f_1$, $f_2$ and transmits acoustic signals at a difference frequency. A representative acoustic low pass filter is described in U.S. Patent Application Publication 2016/00013871, which is incorporated herein by reference.

The acoustic resonator 102 of FIG. 1A can also be configured so that the acoustic transducer 105 receives a modulated electrical signal 120. In the example of FIG. 1B, the modulated electrical signal 120 is associated with modulation of a carrier frequency f at a difference frequency Δf. As in FIG. 1A, an acoustic signal 122 is output at the difference frequency.

In a further example shown in FIG. 1C, an acoustic resonator 130 includes a nonlinear material 132 and first and second acoustic transducers 134, 136. A first electrical signal 138 and a second electrical signal 140 at respective frequencies $f_1$, $f_2$ are coupled to the first and second transducers 134, 136 so as to produce corresponding acoustic signals 139, 141. Based on interaction in the nonlinear material 132, an acoustic signal 144 is output at the difference frequency.

In other examples, one or more acoustic transducers are situated on opposing ends of the acoustic resonator, or three or more transducers are provided for coupling to electrical signals at three or more different frequencies so that multiple difference frequency acoustic signals are produced. Alternatively, two, three, or more electrical signals can be coupled to a single acoustic transducer.

Figure 2:
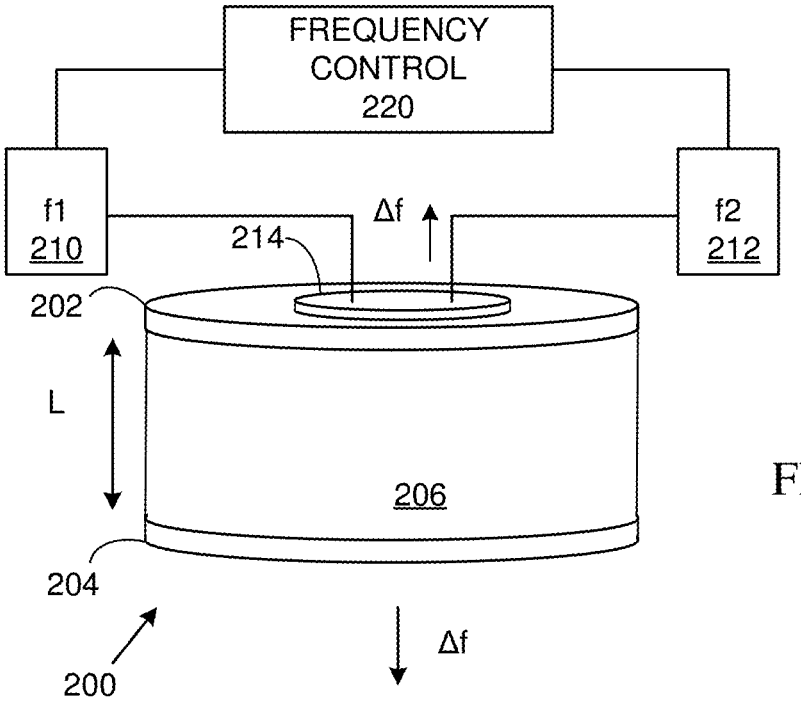
FIG. 2 illustrates a system for generation of lower frequency acoustic signals from higher frequency acoustic signals in an acoustic resonator that contains a nonlinear acoustic material.

With reference to FIG. 2, an acoustic signal generator 200 includes acoustic reflectors 202, 204 that define an acoustic resonator that contains a nonlinear acoustic material 206. At least the acoustic reflector 204 is transmissive to difference frequency acoustic signals generated in the nonlinear acoustic material 206. A first electrical signal source 210 and a second electrical signal source 212 are coupled to provide electrical signals at frequencies $f_1$, $f_2$, respectively, to a transducer 214. (A single source can be used to provide both signals, or to provide a modulated carrier as shown in FIG. 1B above). As shown in FIG. 2, the acoustic resonator has a length L and has cavity resonance frequencies at integer multiples of v/2L, wherein v is acoustic speed in the resonator. To promote difference frequency generation, a frequency controller 220 is coupled to the signal sources 210, 212 so that each can be tuned to be at a cavity resonance frequency. This increases acoustic field amplitude in the acoustic resonator at frequencies $f_1$, $f_2$ and thus increases output power at the difference frequency. In addition, preferred output frequencies (i.e., those associated with resonance at frequencies $f_1$, $f_2$) are thus at integer multiples of v/2L. FIG. 2 also illustrates a difference frequency acoustic signal exiting the acoustic resonator at the transducer 214. In most cases, the amplitude of this acoustic signal is relatively small. In one example, $f_1$=1 MHz, and $f_2$=1.1 MHz, and a difference frequency of 100 kHz is generated.

If the cavity length L (in this example, approximately the same as the nonlinear material length) is sufficiently long, i.e., at least 3, 4, 5, 6, 7, 8, 10, 15, 20, or 50 times an acoustic wavelength corresponding to the difference frequency, a difference frequency acoustic signal beam width/collimation is defined by the beam width/collimation of the acoustic signals at frequencies $f_1$, $f_2$ which generally will have narrow beam widths.

Figure 3A:
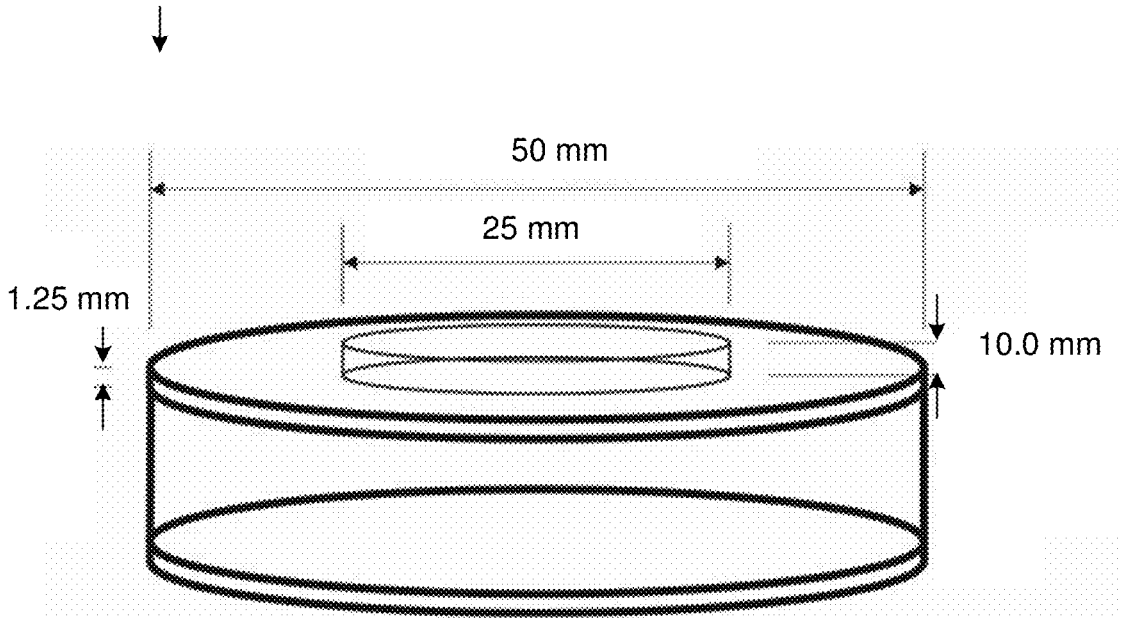
FIG. 3A illustrates a representative acoustic resonator.
Figure 3B:
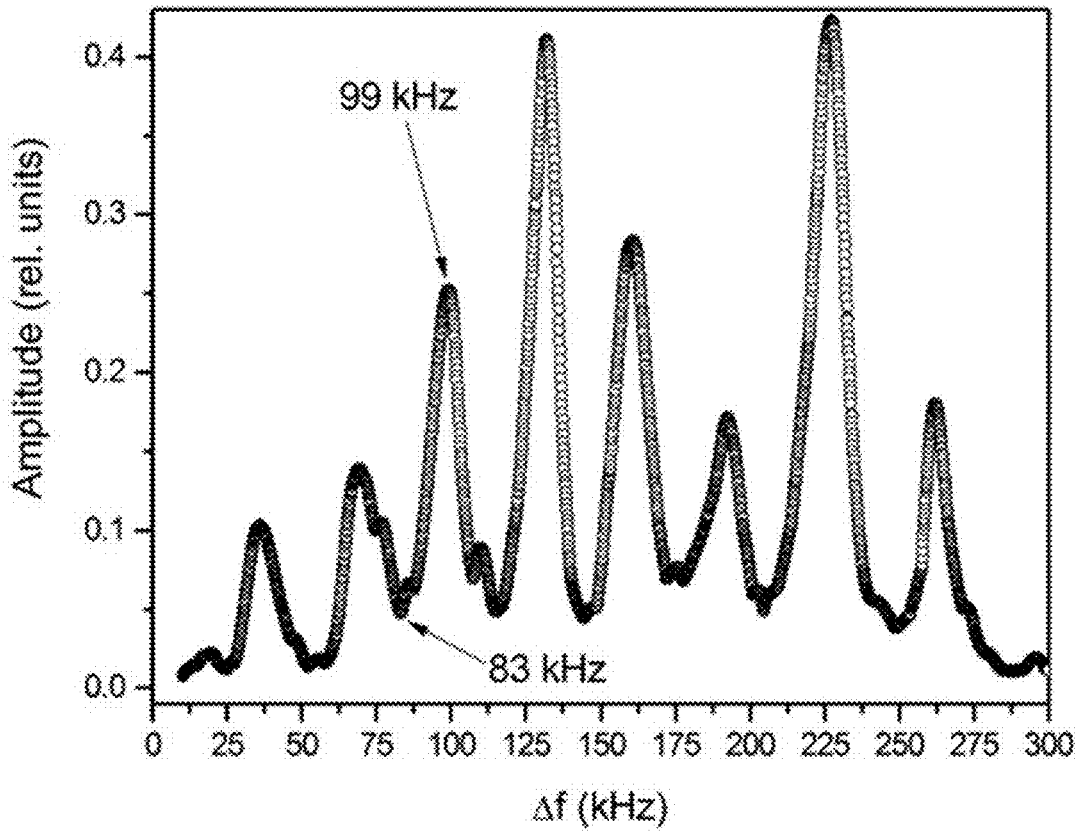
FIG. 3B is a graph showing amplitudes of an acoustic difference frequency signal as a function of frequency, wherein $f_1$=1 MHz, and $f_2$ is scanned from 1.01-1.3 MHz.

By situating an acoustic nonlinear material in an acoustic resonator, an effective interaction length can be longer than the actual single pass interaction length. Difference frequency signal enhancement is illustrated with reference to FIGS. 3A-3B. FIG. 3A illustrates representative dimensions of an acoustic resonator such as shown above in FIG. 2 using FLUORINERT FC-43 available from Sigma Aldrich as a nonlinear material. Other materials, solids, liquids (even water) or gases, with high acoustic nonlinearity can be also used. A resonator cavity length is 10 mm. The importance of resonance tuning is illustrated by the variation in on-resonance and off-resonance difference frequency acoustic signal amplitudes as shown in FIG. 3B. The enhancement in signal strength is a factor of 10 due to resonance. Resonance and nonlinear frequency mixing allows the generation of a collimated acoustic beam at the difference frequency.

In one example, an acoustic signal at a fixed frequency $f_1$=1 MHz was applied while an acoustic signal at a frequency $f_2$ was swept between 1.01 MHz and 1.0 MHz, such that the difference frequency had values between 10-100 kHz. Referring to FIG. 3B, multiple resonant frequencies (local maxima) and off-resonant frequencies (local minima) that are associated with constructive and destructive interference are shown. Resonances are separated by about 32 kHz which corresponds to v/2L, wherein L=10 mm and v is the speed of sound in FLUORINERT, i.e., v is about 640 m/s.

Figure 3C:
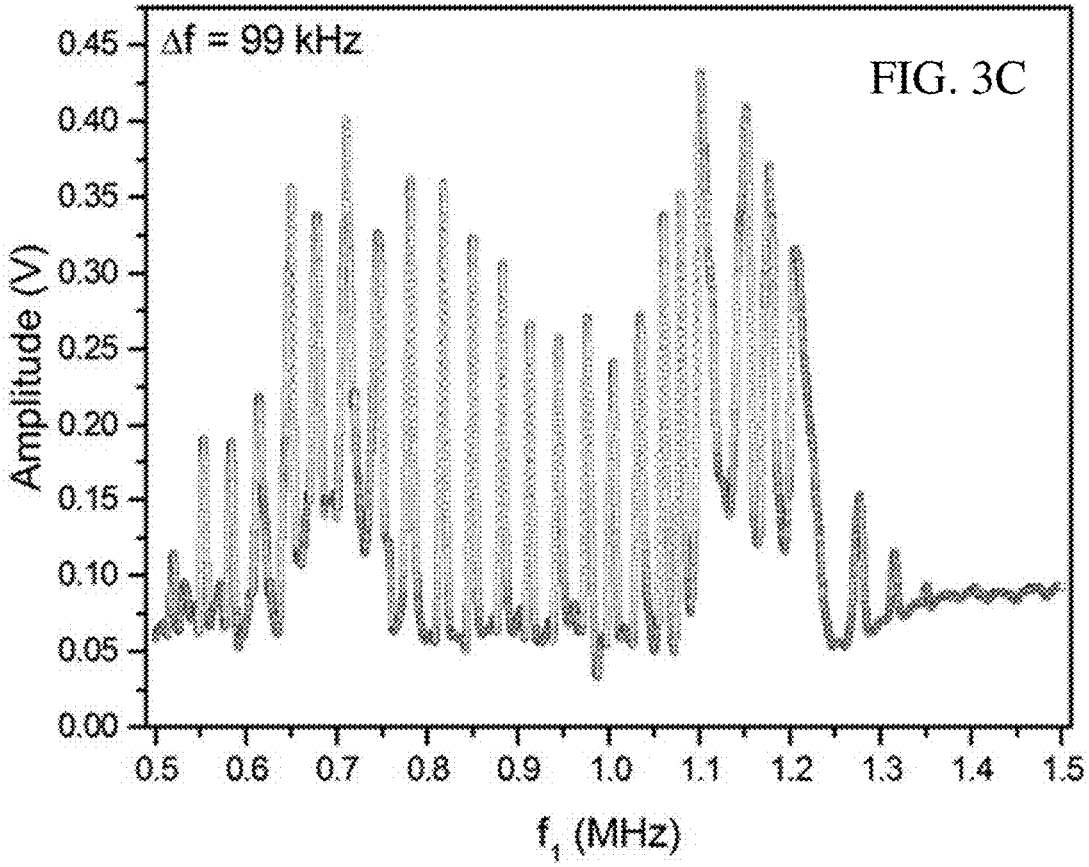
FIG. 3C is a graph showing amplitudes of an acoustic difference frequency signal, wherein the difference frequency $\Delta f$=99 kHz corresponds to a resonance frequency, $f_1$ is between 0.5-1.5 MHz, and $f_2=f_1+\Delta f$.

In another example, a difference frequency Δf is set to a constant value corresponding to a resonance in FIG. 3B (in this example, 99 kHz) and an acoustic signal at frequency $f_1$ is swept between 500 kHz and 1.5 MHz while an acoustic signal at $f_2$ is swept so that $f_2=f_1+\Delta f$. The resulting acoustic signal output amplitude as a function of $f_1$ is illustrated in FIG. 3C.

Figure 3D:
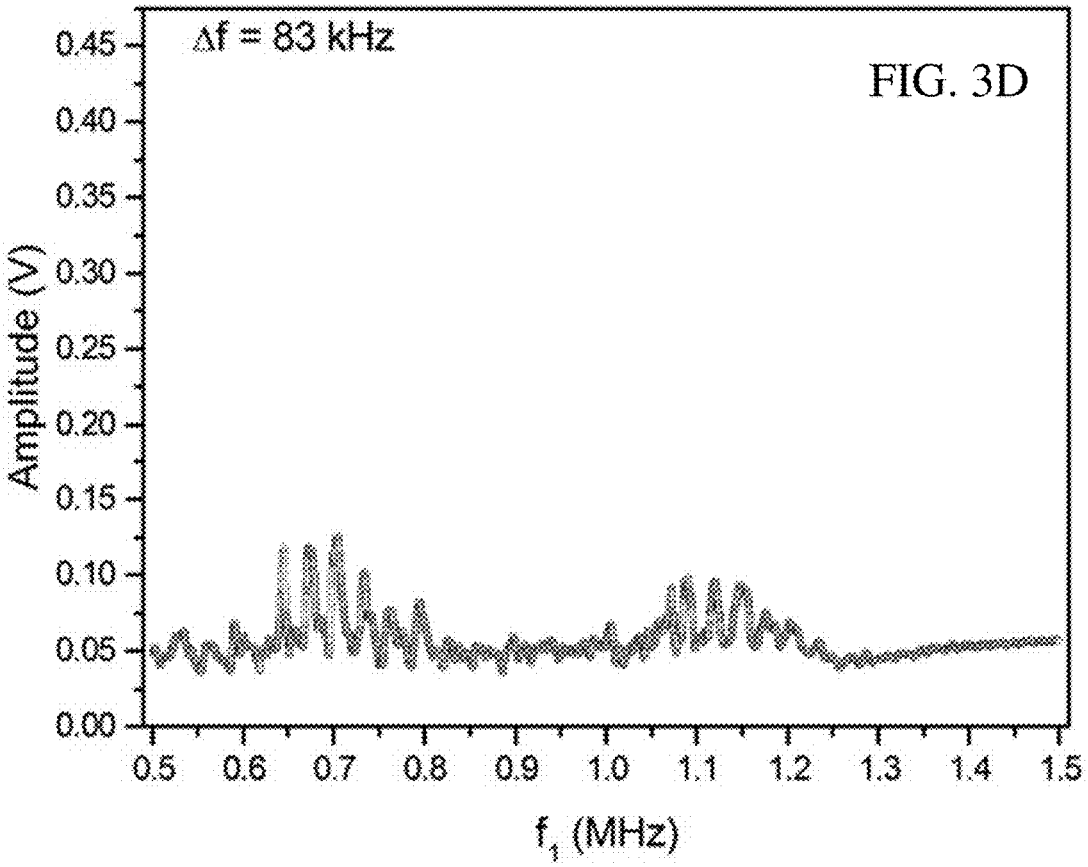
FIG. 3D is a graph showing amplitudes of an acoustic difference frequency signal, wherein the difference frequency $\Delta f$=83 kHz corresponds to an off-resonance frequency, $f_1$ is between 0.5-1.5 MHz, and $f_2=f_1+\Delta f$.
Figure 3E:
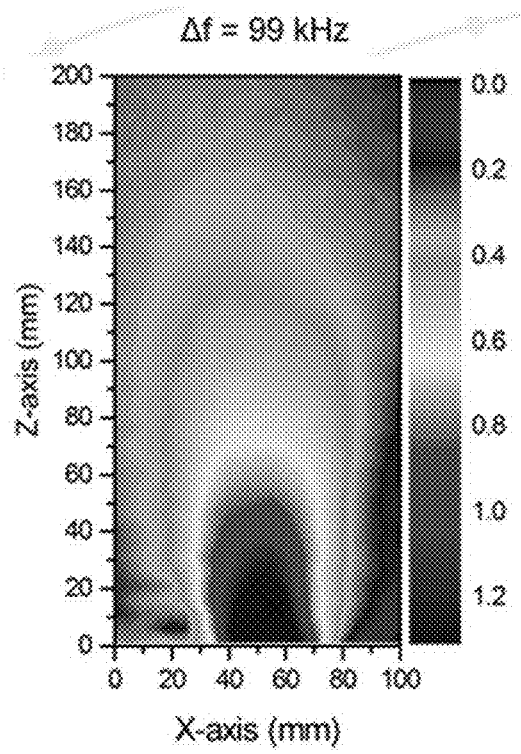
FIGS. 3E-3F are two-dimensional difference frequency beam profiles obtained from acoustic signals propagating in a water tank. The acoustic signal amplitudes correspond to FIGS. 3B-3D.
Figure 3F:
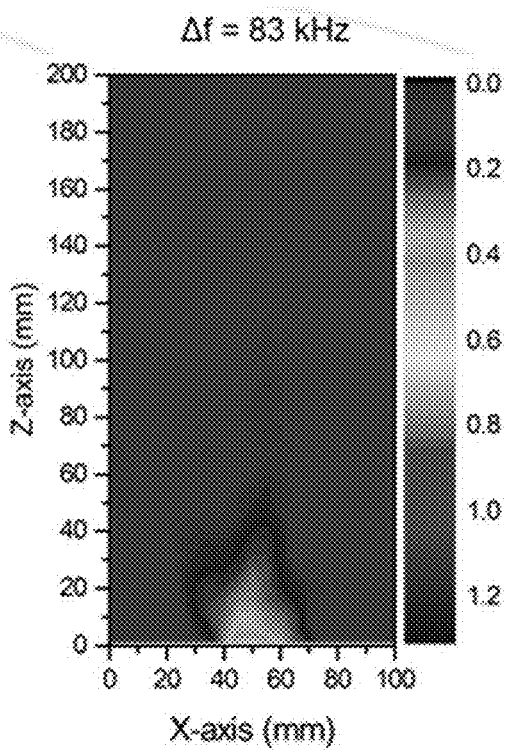

In another example, by contrast, the difference frequency Δf is set to a constant value corresponding to off-resonance (destructive interference) in FIG. 3B (in this example, 83 kHz) and $f_1$ is swept between 500 kHz and 1.5 MHz while $f_2$ is swept so that $f_2=f_1+\Delta f$. The resulting acoustic signal output amplitude as a function of $f_1$ is illustrated in FIG. 3D, showing reduced acoustic signal amplitude at the difference frequency with respect to FIG. 3C due to being off-resonance. FIGS. 3E-3F show beam profiles for on and off resonance, respectively.

Figure 3G:
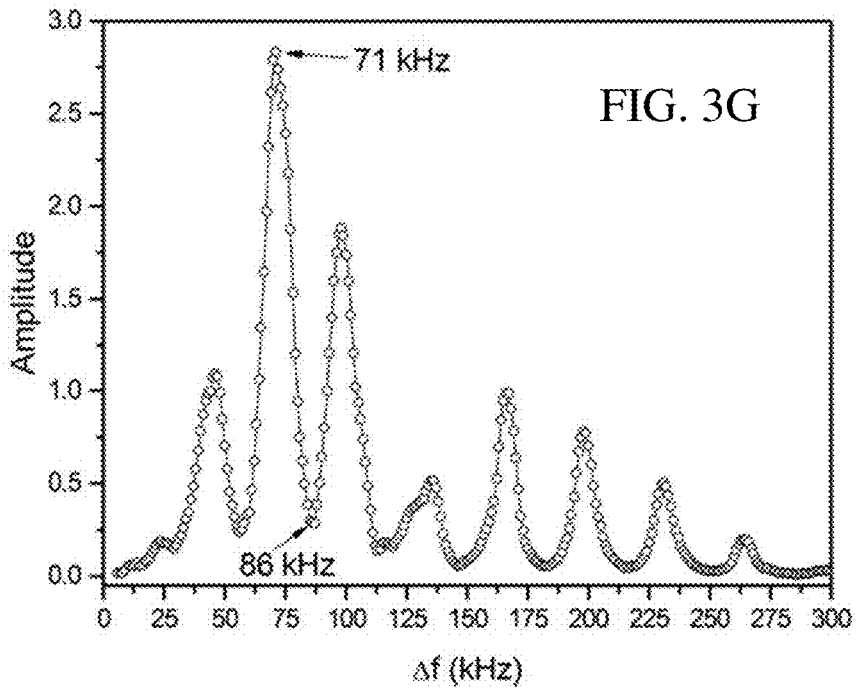
FIG. 3G illustrates acoustic difference signal amplitude as a function of frequency for $f_1$=1.074 MHz and $f_2$ in a range of 1.08-1.5 MHz.

In yet another example, different primary frequencies were used. An example is shown in FIG. 3G, wherein $f_1$ is fixed at $f_1$=1.074 MHz and $f_2$ is swept between 1.08 MHz and 1.5 MHz, such that Δf=10-300 kHz. A gain in amplitude of about 10× was observed at resonance.

It is important to point out that acoustic difference frequency beams produced using nonlinear mixing propagate with beam characteristics corresponding to the input beam or beams, and do not exhibit side lobes that typically accompany traditional sources. Such side lobes degrade or complicate distance measurements and the effects of side lobes must generally be eliminated with complex signal processing procedures.

Any of various nonlinear acoustic materials can be used including liquids such as water, alcohols, FLUORINERTS, e.g. FC-43, glycerol, solids such as cracked/damaged materials, porous materials, micro-structured/micro-inhomogeneous materials, acoustic metamaterials, granular materials such as spherical/non-spherical beads (hollow or full), sandstones, composites, concrete, flexible materials such as sheet molding compounds, polymers (polypropylene, phenolic polymer, etc.), silicone rubber, and polystyrene. Generally materials with an effective nonlinear parameter β of at least 5, 7, or 10 are preferred.

Figure 4:
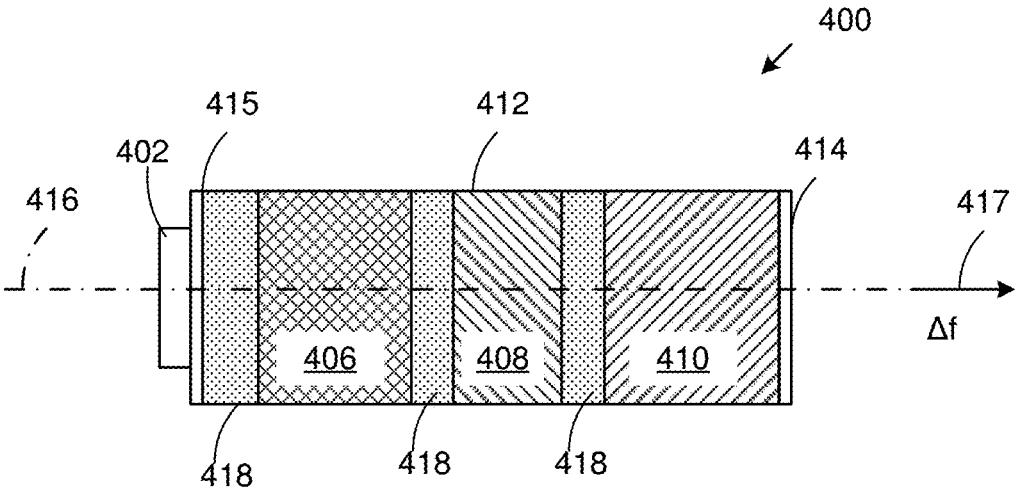
FIG. 4 illustrates an acoustic resonator that contains different acoustic nonlinear materials.

Referring to FIG. 4, an acoustic resonator 400 includes an acoustic transducer 402 situated to direct acoustic waves to acoustic nonlinear media 406, 408, 410 that are situated in a housing 412. An acoustic reflector 414 is situated to reflect acoustic signals at one or more carrier frequencies and transmit an acoustic beam 417 at a difference frequency. An acoustic reflector 415 can be situated to reflect acoustic signals as well. The acoustic nonlinear media 406, 408, 410 can have different lengths along a resonator axis 416 and can be of the same or different materials. Spaces 418 between the acoustic nonlinear materials can be filled with other acoustic media so as to reduce acoustic reflections at interfaces.

Figure 5:
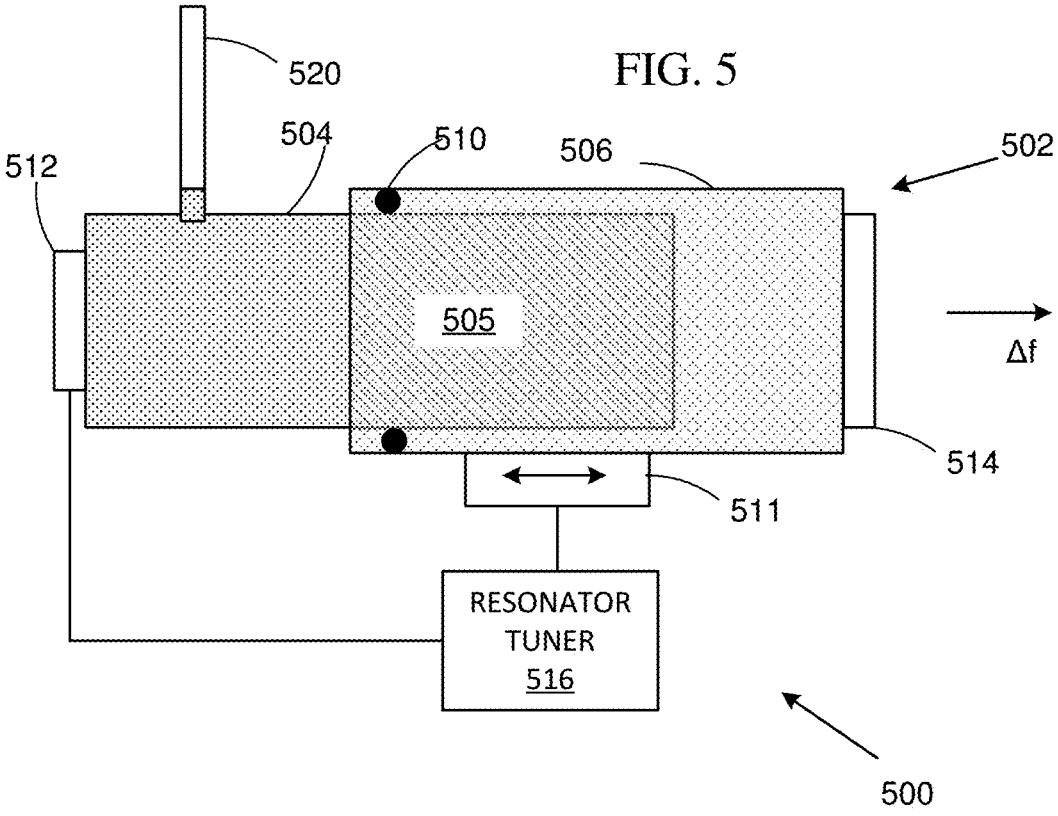
FIG. 5 illustrates a length-adjustable acoustic resonator.

With reference to FIG. 5, a representative acoustic signal generator system 500 includes an acoustic resonator 502 and a resonator tuner 516. The acoustic resonator 502 includes a liquid nonlinear acoustic material 505 that is confined by a first resonator tube 504 and a second resonator tube 506 that are positioned to slide with respect to each other to adjust a resonator length. The first and second resonator tubes 504, 506 are fluidically sealed with a gasket or O-ring 510. An acoustic transducer 512 and an acoustic reflector 514 are situated at opposite ends of the acoustic resonator 502 and define a resonator length. The resonator tuner 516 is coupled to a mechanical stage 511 (or a piezoelectric device, micrometer, screw or other length adjustment) so that a cavity length can be adjusted to select resonance frequencies of the acoustic resonator 502, i.e., adjust v/2L. In other examples, the first and second resonator tubes are coupled by a bellows. As shown in FIG. 5, a fill/overflow tube 520 is coupled so that acoustic nonlinear fluid can be provided or removed as the resonator length is adjusted. Resonator length can also be adjusted manually, if desired. Because a generated difference frequency is preferably a positive integer multiple of v/2L, length tuning permits more efficient generation of a particular difference frequency.

Figure 6:
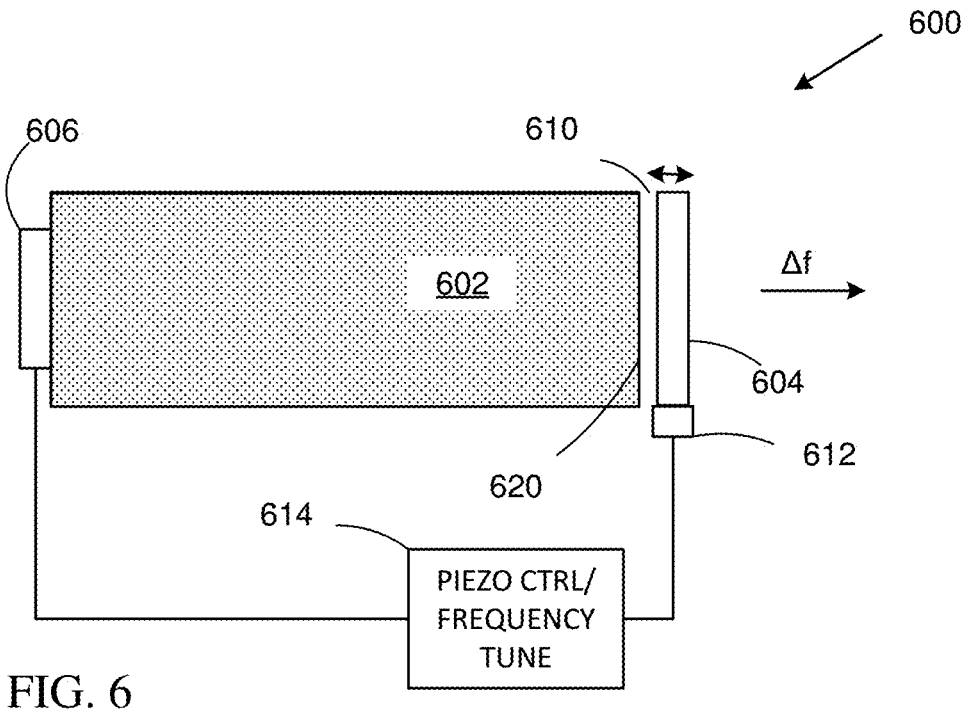
FIG. 6 illustrates another representative length-adjustable acoustic resonator.

Referring to FIG. 6, an acoustic resonator 600 includes nonlinear acoustic material 602 situated between an acoustic reflector 604 and an acoustic transducer 606 that define a resonator length. An acoustic reflector can also be provided at the acoustic transducer 606. Any acoustic reflectors preferentially transmit acoustic signals at a difference frequency, and reflect acoustic signals at fundamental (carrier) frequencies. A gap 610 separates the acoustic mirror 604 and the nonlinear acoustic material 602. A piezoelectric positioner 612 is coupled to the acoustic mirror 604 so that a resonator length can be adjusted using a piezoelectric controller 614. Preferably, the gap 610 is filled with an acoustic impedance matching material to reduce acoustic reflections at an end 620.

Figure 7:
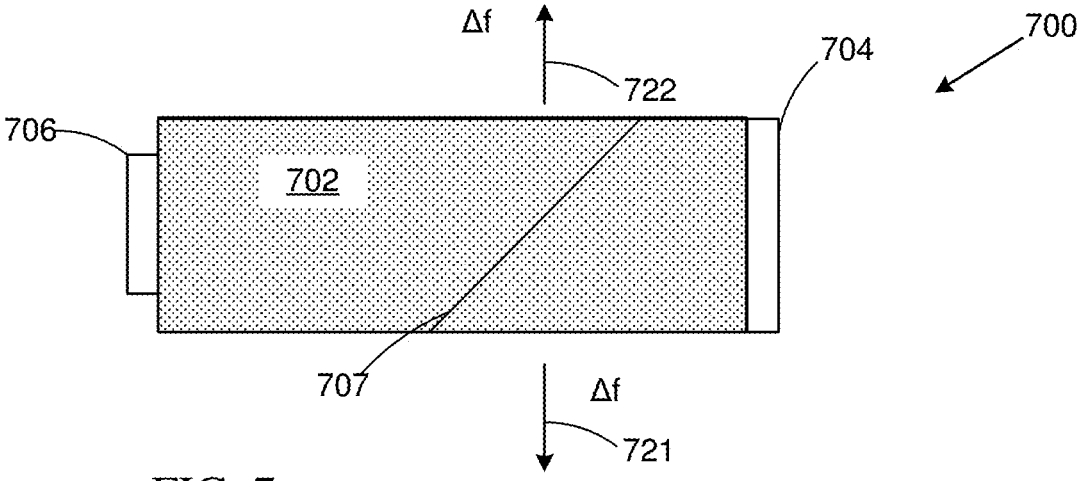
FIG. 7 illustrates an acoustic resonator having an acoustic reflector situated within a resonator volume.

Referring to FIG. 7, an acoustic resonator 700 includes a nonlinear acoustic material 702 situated between an acoustic reflector 704 and an acoustic transducer 706 that define a resonator length. An acoustic reflector can also be provided at the acoustic transducer 706. An acoustic difference frequency generated in the nonlinear acoustic material 702 can be directed out of the acoustic resonator 700 with an internal acoustic reflector 707 that preferable transmits acoustic signals at carrier frequencies and reflects an acoustic signal at a difference frequency. In this example, the acoustic mirror 704 need not transmit acoustic signals at a difference frequency. Difference frequency acoustic signals 721, 722 can be produced and directed out of the resonator 700.

Figure 8:
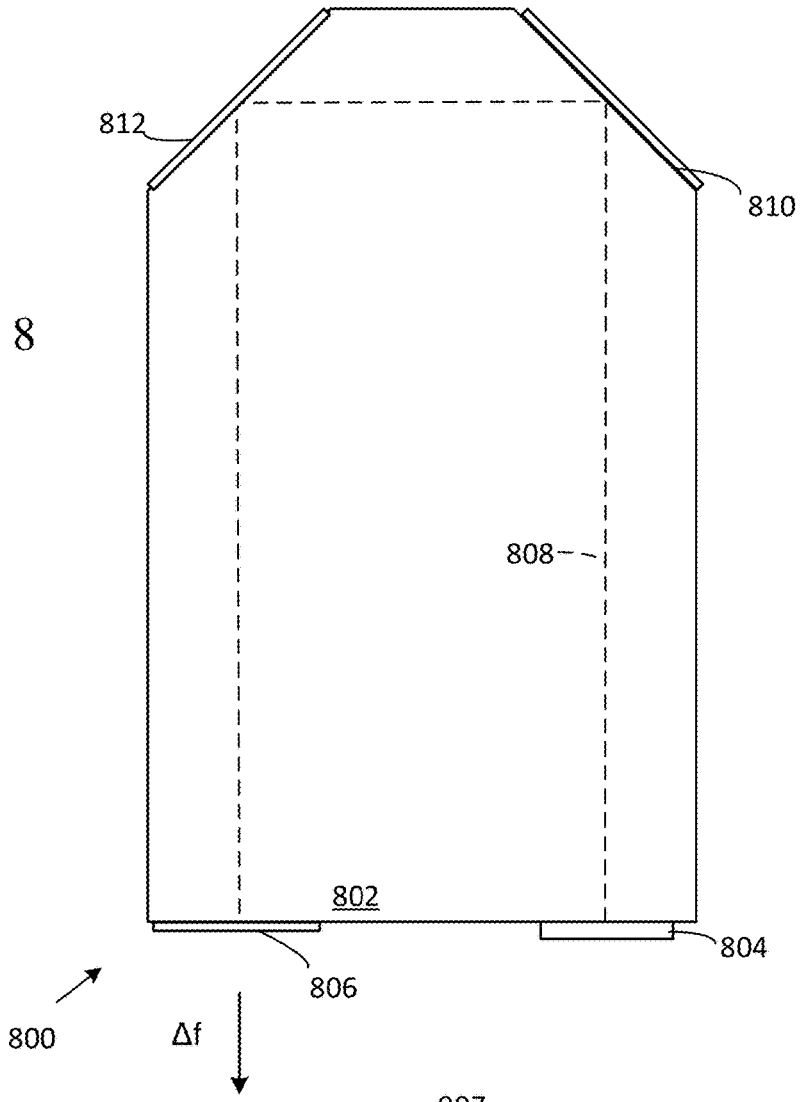
FIG. 8 illustrates an acoustic resonator having a folded acoustic path.
Figure 9:
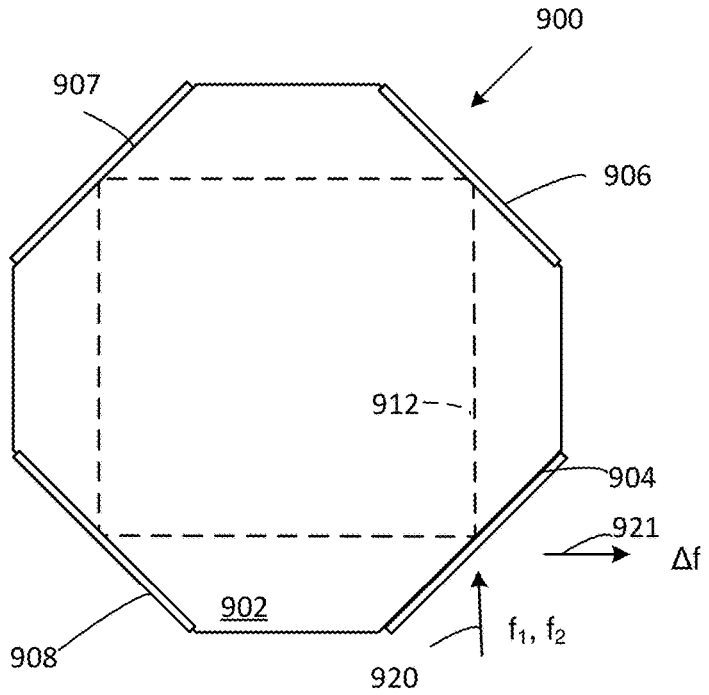
FIG. 9 illustrates a representative acoustic ring resonator that includes an acoustic nonlinear material.

The examples above illustrate linear acoustic resonators, but other configurations can be used. Referring to FIG. 8, an acoustic resonator 800 is defined by a nonlinear acoustic material 802, a transducer 804, and acoustic reflectors 806, 810, 812 that establish a folded acoustic signal propagation axis 808. With reference to FIG. 9, a ring acoustic resonator 900 includes acoustic reflectors 904, 906, 907, 908 that define a ring resonator acoustic signal propagation axis 912 situated in an acoustic nonlinear material 902. Acoustic signals 920 at one or more carrier frequencies are input through the mirror 904 and a difference frequency acoustic signal 921 is output by the mirror 904, although in a different direction than the direction from which the carrier signals are introduced. The acoustic mirror 904 preferentially transmits acoustic signals at difference frequencies. In some examples, the acoustic mirror 904 is omitted, and this associated surface of the acoustic resonator 900 is arranged to transmit at carrier and difference frequencies. Other resonator surfaces can be used for input and output and FIG. 9 shows only one example.

In some disclosed examples, acoustic nonlinear materials are shown as filling an acoustic resonator or having surfaces that define an acoustic resonator. This is for convenient illustration, and tubes and containers of various shapes and sizes can be used, and acoustic nonlinear materials situated in suitable locations, and may or may not fill a resonator cavity.

Acoustic signal sources as described herein can be small and compact, making them useful for many applications such as in biomedical imaging (e.g., endoscopic imaging), imaging of highly attenuating media, and non-destructive testing (NDT). For example, a cylindrical source can have a diameter of less than 5 cm and a thickness of less than 1.5 cm or less. Conventional NDT uses high frequency sources that do not penetrate many specimens of interest.

Figure 10:
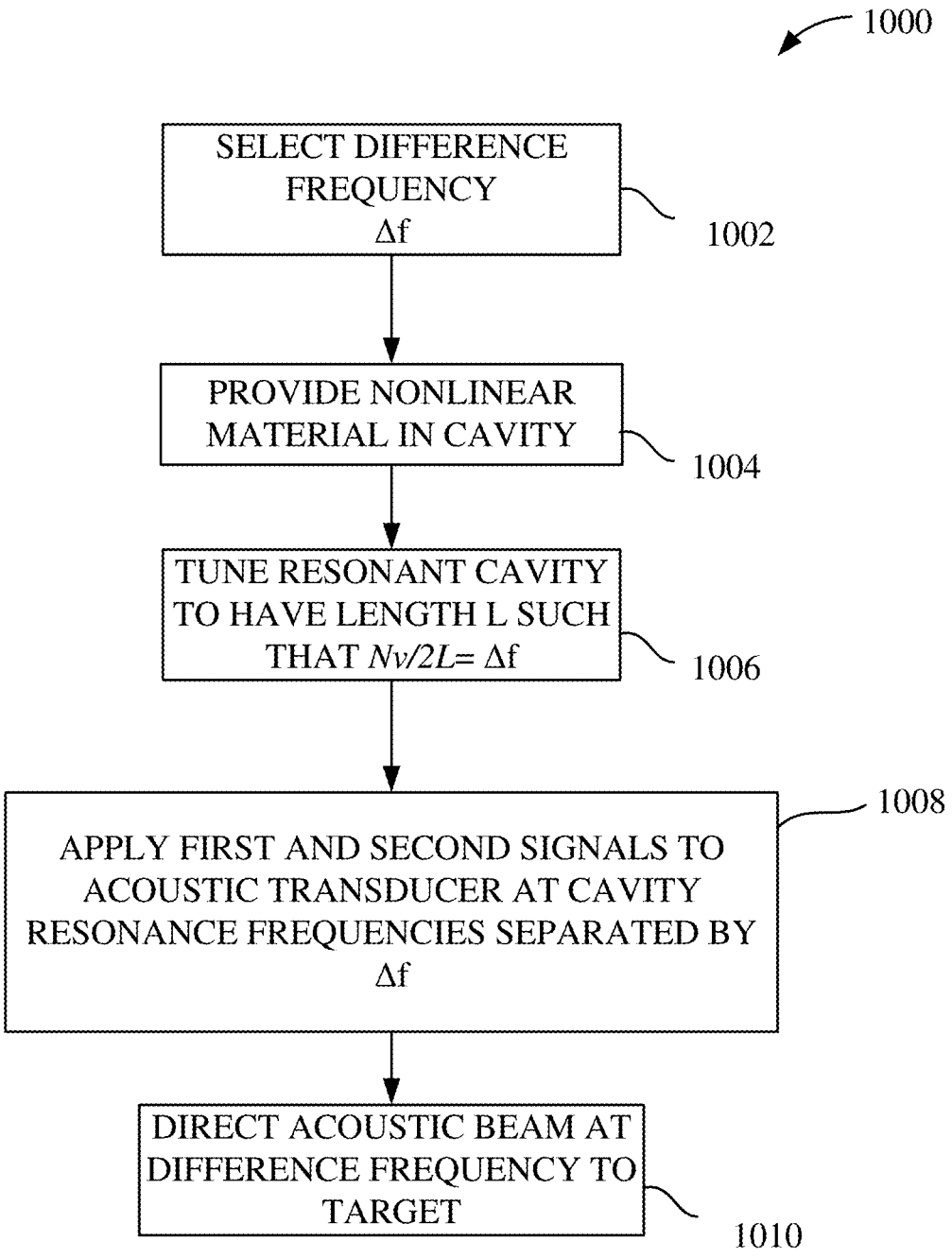
FIG. 10 illustrates a method of producing an acoustic difference frequency using an acoustic resonator that contains an acoustic nonlinear material.

A typical method 1000 is illustrated in FIG. 10. At 1002, a difference (i.e. output) frequency is selected. At 1004 a nonlinear material is provided in an acoustic resonator cavity. At 1006, the resonator is tuned so that the selected frequency corresponds to a resonance frequency (i.e., so that $Nv/2L=\Delta f$, wherein N is a positive integer, v is a speed of sound in the nonlinear material, and L is a cavity length. Similar relations apply for resonators in which a resonant cavity includes media having different or variable speed of sound. At 1008, first and second electrical signals are applied to an acoustic transducer to produce corresponding acoustic signals at respective resonance frequencies. At 1010, a resulting acoustic beam at a difference frequency is directed to a target.

In view of the many possible embodiments to which the principles of the disclosed technology may be applied, it should be recognized that the illustrated embodiments are only representative examples and should not be taken as limiting the scope of the disclosure. Alternatives specifically addressed in these sections are merely exemplary and do not constitute all possible alternatives to the embodiments described herein. For instance, various components of systems described herein may be combined in function and use. We claim all that comes within the scope and spirit of the appended claims.

We claim:

1. An acoustic source, comprising:

an acoustic resonator defining a resonator volume;

an acoustic nonlinear material situated in the resonator volume;

an acoustic transducer situated to direct an acoustic signal into the resonator volume; and an electrical signal source coupled to the acoustic transducer so as to apply an electrical signal at at least one carrier frequency to the acoustic transducer and produce a collimated acoustic beam at a difference frequency based on a nonlinear coefficient of the acoustic nonlinear material, wherein the carrier frequency is at least 0.5 MHz.

2. The acoustic source of claim 1, wherein the electrical signal at the at least one carrier frequency is an amplitude modulated electrical signal at a selected carrier frequency and the difference frequency is a frequency of the amplitude modulation.

3. The acoustic source of claim 1, wherein the electrical signal at at least one carrier frequency includes electrical signals at a first frequency and a second frequency, and the difference frequency corresponds to a difference between the first frequency and the second frequency.

4. The acoustic source of claim 1, wherein the acoustic nonlinear material has an effective acoustic nonlinear parameter $\beta$ of at least 5.

5. The acoustic source of claim 1, wherein the acoustic resonator has a Q of at least 5.

6. The acoustic source of claim 1, wherein the acoustic resonator is a linear resonator.

7. The acoustic source of claim 1, wherein the acoustic resonator includes an acoustic mirror that preferentially transmits the acoustic signal at the difference frequency and reflects the acoustic signal at the at least one carrier frequency.

8. The acoustic source of claim 1, wherein the acoustic nonlinear material fills the resonator volume.

9. The acoustic source of claim 1, wherein the acoustic nonlinear material situated in the acoustic resonator volume includes a first acoustic nonlinear material and a second acoustic nonlinear material.

10. The acoustic source of claim 1, wherein the electrical signal at the at least one carrier frequency is tunable so as to correspond to an acoustic cavity resonance frequency.

11. The acoustic source of claim 1, wherein the acoustic resonator comprises a first acoustic resonator section having a first length and a second acoustic resonator section having a second length, wherein the first acoustic resonator section and the second acoustic resonator section are operable to adjust a total resonator length.

12. The acoustic source of claim 11, further comprising a bellows that couples the first acoustic resonator section and the second acoustic resonator section so that the first acoustic resonator section and the second acoustic resonator section are movable to adjust a total resonator length.

13. The acoustic source of claim 11, further comprising an O-ring seal situated between the first acoustic resonator section and the second acoustic resonator section so that the first acoustic resonator section and the second acoustic resonator section are slidable with respect to each other so as to adjust a total resonator length.

14. The acoustic source of claim 13, wherein the acoustic nonlinear material is a liquid, and the O-ring seal is situated between the first acoustic resonator section and the second acoustic resonator section to confine the acoustic nonlinear material with the first acoustic resonator section and the second acoustic resonator section.

15. The acoustic source of claim 1, wherein the acoustic nonlinear material is FLUORINERT FC-43.

16. The acoustic source of claim 1, wherein the acoustic resonator defines a folded resonator axis.

17. The acoustic source of claim 1, wherein the acoustic resonator is a ring resonator.

18. A system for generating an acoustic signal, comprising:

an acoustic resonator defining a resonator volume;

an acoustic nonlinear material situated so as to at least partially fill the resonator volume;

a tunable electrical signal source that produces an electrical signal at at least one tunable frequency, wherein the tunable frequency is at least 0.5 MHz; and an acoustic transducer coupled to the tunable electrical signal source and situated to direct an acoustic signal in response to the electrical signal into the acoustic resonator at an acoustic resonator resonance frequency so as to produce and output a collimated acoustic beam at a difference frequency.

19. The system of claim 18, wherein the tunable electrical signal source is tunable to produce an amplitude modulation of an electrical carrier signal, wherein a frequency of the electrical carrier signal is a resonance frequency of the acoustic resonator, and a frequency of the amplitude modulation is a resonance frequency of the acoustic resonator.

20. The system of claim 18, wherein the tunable electrical signal source is tunable to produce first and second electrical carrier signals at a first frequency and a second frequency, respectively, wherein frequencies of the first and second electrical carrier signals are resonance frequencies of the acoustic resonator, and the difference frequency corresponds to a difference between the first frequency and the second frequency.

21. The system of claim 18, further comprising an acoustic resonator tuner coupled to adjust resonance frequencies of the acoustic resonator.

22. The system of claim 21, wherein the acoustic resonator tuner is a piezoelectric device, a screw, or a mechanical stage.

23. The system of claim 18, wherein the acoustic resonator includes a first section and a second section that are movable with respect to each other so as to adjust resonance frequencies of the acoustic resonator.

24. The system of claim 18, wherein the acoustic resonator includes a low pass filter situated to transmit an acoustic signal at the difference frequency.

25. A method, comprising:

applying a first electrical signal at a frequency of at least 0.5 MHz to at least one acoustic transducer to produce a first acoustic signal;

directing the first acoustic signal into an acoustic resonator;

tuning the electrical signal so that the first acoustic signal is at a frequency corresponding to a resonance frequency of an acoustic resonator that contains an acoustic nonlinear material;

applying a second electrical signal at a frequency of at least 0.5 MHz to the at least one acoustic transducer to produce a second acoustic signal;

directing the second acoustic signal into an acoustic resonator; and tuning the second electrical signal so that the second acoustic signal is at a frequency corresponding to a resonant frequency of the acoustic resonator so that the first and second acoustic signals produce a collimated acoustic beam at a difference frequency based on interaction in the acoustic nonlinear material.

* * * * *